United States Patent [19]

Honsinger et al.

[11] 4,155,397

[45] May 22, 1979

[54] METHOD AND APPARATUS FOR FABRICATING AMORPHOUS METAL LAMINATIONS FOR MOTORS AND TRANSFORMERS

[75] Inventors: Vernon B. Honsinger, Ballston Lake; Russell E. Tompkins, Scotia, both of N.Y.

[73] Assignee: General Electric Company, Schenectady, N.Y.

[21] Appl. No.: 903,140

[22] Filed: May 5, 1978

[51] Int. Cl.[2] ..... B22D 11/06

[52] U.S. Cl. ..... 164/5; 164/70; 164/87; 164/260; 164/263; 164/423; 164/429

[58] Field of Search ..... 164/5, 69, 70, 87, 260, 164/263, 423, 429

[56] References Cited

U.S. PATENT DOCUMENTS

| | | | |
|---|---|---|---|
| 3,188,505 | 6/1965 | Wiley | 310/259 |
| 3,789,909 | 2/1974 | Smith | 164/87 |
| 3,862,658 | 1/1975 | Bedell | 164/423 X |
| 3,881,542 | 5/1975 | Polk et al. | 164/87 |
| 4,067,732 | 1/1978 | Ray | 75/126 P |
| 4,077,462 | 3/1978 | Bedell et al. | 164/429 |

FOREIGN PATENT DOCUMENTS

| | | | |
|---|---|---|---|
| 1040498 | 8/1966 | United Kingdom | 164/87 |

OTHER PUBLICATIONS

Potential of Amorphous Metals for Application in Magnetic Devices, Luborsky et al., Journal of Applied Physics, vol. 49, No. 3, Mar. 1978, pp. 1769–1774.

Metalic Glasses, American Soc. for Metals, Jan. 1978, pp. 36–38.

Casting of Metallic Filament and Fiber, Maringer et al., J. Vac. Sci. Tech., vol. 11, No. 6, Nov. 1974, pp. 1067–1071.

Centrifugal Spinning of Metallic Glass Filaments, Chen et al., Mat. Res. Bull., vol. 11, pp. 49–54, 1976.

*Primary Examiner*—Robert D. Baldwin

*Attorney, Agent, or Firm*—Donald R. Campbell; Joseph T. Cohen; Marvin Snyder

[57] ABSTRACT

Liquid amorphous metal alloy is manufactured into shaped laminations ready for assembly in an inductive component in one process. The rotating chill surface to which the melt is delivered has high thermal conductivity metal in a pattern corresponding to the shaped lamination and is surrounded by thermally insulating material. Melt coming in contact with the high thermal conductivity metal becomes amorphous and that contacting the thermally insulating areas cools more slowly and becomes crystalline. The brittle crystalline scrap is broken away from the strip of laminations and is collected and recycled to the melt.

14 Claims, 5 Drawing Figures

METHOD AND APPARATUS FOR FABRICATING AMORPHOUS METAL LAMINATIONS FOR MOTORS AND TRANSFORMERS

BACKGROUND OF THE INVENTION

This invention relates to the manufacture of magnetic laminations for inductive components and especially to a method and apparatus for continuously making, without a separate punching step, a strip of shaped amorphous metal laminations for electric machines and transformers and other inductive components.

Motors and transformers are made up of laminations with varying degrees of geometrical complexity, and conventional practice is that expensive carbide dies are used to punch laminations from steel strip. This process is time consuming and results in about 50% scrap which is sold back to the steel mill at scrap prices, and there are handling and transportation costs.

Amorphous metals are also known as metallic glasses and exist in many different compositions including a variety of magnetic alloys which include iron group elements and boron. Metallic glasses are formed from metal alloys that can be quenched without crystallization, and these solids have unusual and in some cases outstanding physical properties. Because their atoms are bound together by long-range metallic bonding, these alloys are malleable and good electrical conductors. Amorphous metals are mechanically stiff, strong and ductile, and the ferromagnetic types have very low coercive forces and high permeabilities. In electronic applications, these materials are capable of approximately equalling or in some respects exceeding the properties of conventional Fe-Ni, Fe-Co, and Fe-Si alloys, and offer a substantial cost saving. In power applications the potential improvement in properties is far greater; $Fe_{80}B_{20}$ amorphous metal ribbons have one-fourth the losses, at a given induction for sinusoidal flux, of the best oriented Fe-Si sheet steel. Additional information is given in the article "Potential of Amorphous Metals for Application in Magnetic Devices" by F. E. Luborsky, J. J. Becker, P. G. Frischmann, and L. A. Johnson *Journal of Applied Physics,* Vol. 49, No. 3, Part II, March 1978, pp. 1769–1774.

Amorphous metal is manufactured in ribbons of 2 mil thickness or less; the thickness limitation is set by the rate of heat transfer through the already solidified material, which must be rapid enough that the last increment of material to solidify still avoids crystallization. This is several times smaller than currently used materials, but thinness gives amorphous metals an inherent advantage with respect to the geometrical control of eddy current losses. While it may be possible to construct inductive components from strips of uniform width, most electric machines and transformers are built with stacks of punched or shaped laminations. Laminations are designed to direct the magnetic flux toward the direction of action without air gaps between laminations, and therefore there are advantages in this type of magnetic structure. It would be easier to make the shaped lamination while processing the material than in punching the material after fabrication. This is particularly advantageous because of the additional punching necessary while using 2 mil thick strip.

SUMMARY OF THE INVENTION

Liquid amorphous metal alloy is fabricated into a long ribbon and fashioned as a strip of geometrically shaped laminations in the same process; the strip of laminations after cutting apart are ready for assembly into magnetic structures for motors and transformers and other inductive components. A stream of liquid alloy melt is delivered against a relatively rapidly moving cylindrical chill roll or other chill surface having high thermal conductivity material such as copper in a pattern corresponding to the shaped lamination which is surrounded or partially surrounded by flush-mounted low thermal conductivity material such as alumina. The liquid alloy is quenched at different cooling rates and moves away from the chill cylinder to continuously form a ribbon of solidified metal composed of ductile amorphous metal in the shaped lamination pattern and brittle crystalline metal in other areas. The crystalline metal areas are removed as by vibrating the ribbon to leave only a strip of shaped amorphous metal laminations.

An important feature of the invention is that the crystalline metal scrap can be collected and returned to the melt along with new metallic and glasseous element raw materials, with resulting savings in material and labor compared to the conventional process of die punching steel strip. To make a continuous naturally straight strip of laminations capable of being wound radially on a spool, alloy melt is splatted onto the circumferential surface of a chill cylinder rotating about a horizontal axis; and to make a naturally curved strip of laminations capable of being wound helically, alloy melt is splatted onto the flat top surface of a chill cylinder rotating about a vertical axis or onto the inclined circumferential surface of a vertically mounted cylinder. The ribbon in any case separates from the chill roll under the action of centrifugal force. Any of the magnetic alloys can be utilized in practicing the invention, but the examples given are $Fe_{80}B_{20}$ and $Fe_{40}Ni_{40}P_{14}B_6$.

DESCRIPTION OF THE PREFERRED EMBODIMENTS

An infinitely long strip of amorphous metal laminations for motors and transformers and other inductive components is processed by directing a liquid alloy of metals and glasseous elements onto a very cold rotating cylinder. There are several different methods and arrangements of the apparatus, but the object of the processing equipment is to change the liquid alloy into a solid ribbon of uniform width in a short time, measured in microseconds, before it becomes crystalline. The noncrystallized amorphous metal as processed is quite ductile and easy to work, while the crystalline strip of this metal, produced by slowing the cooling rate of the liquid alloy so that crystals have time to form, is very brittle. The production of brittle crystalline metal is normally considered to be detrimental, but is employed to advantage in the direct or one-process continuous fabrication of a strip of geometrically shaped laminations from a liquid alloy melt. Moreover, the brittle crystalline metal is completely recovered as scrap particles and is recycled back into the alloy melt.

Figure 1:
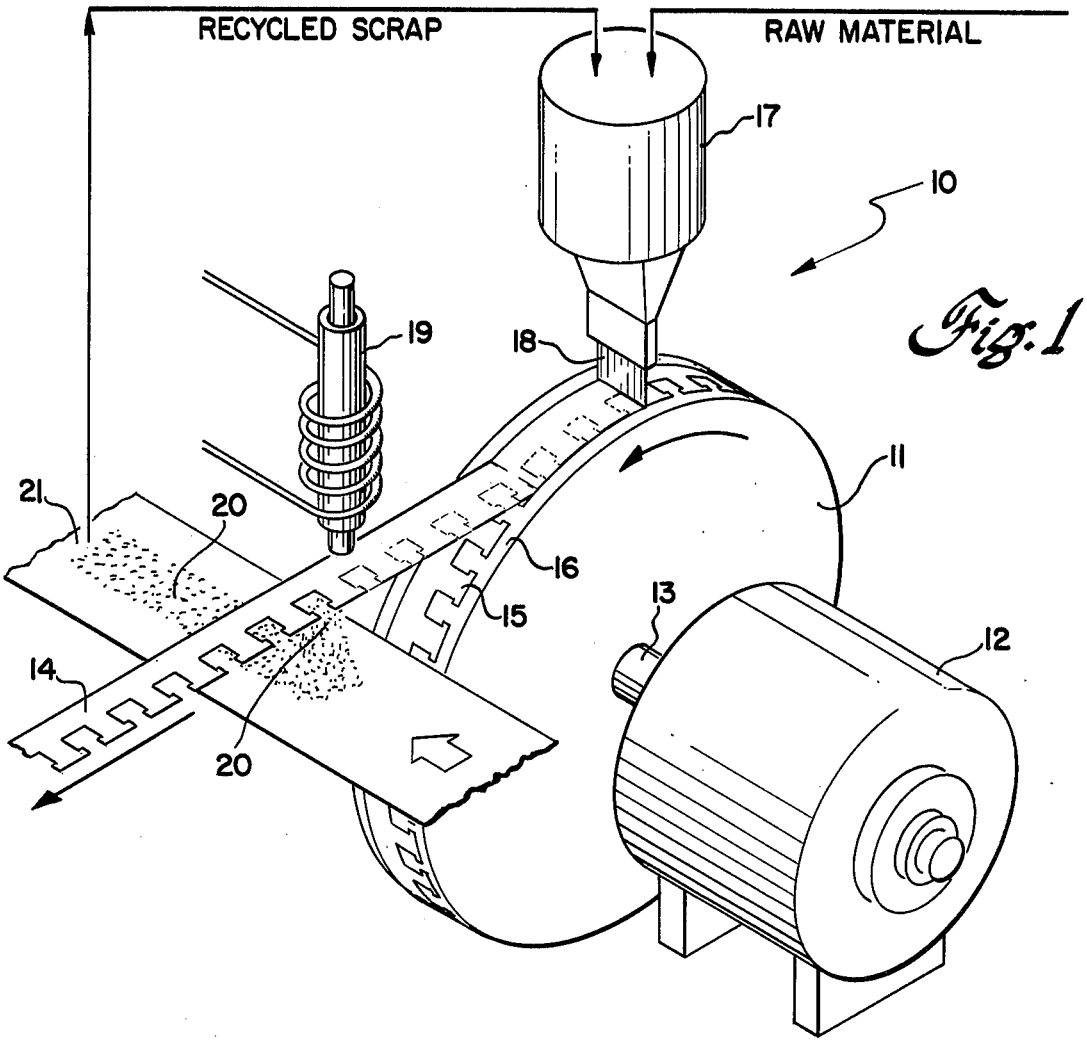
FIG. 1 is a diagrammatic perspective view of apparatus for fabricating a strip of amorphous metal laminations in one process.

Chill roll assembly 10 in FIG. 1 is comprised of a chill cylinder or roll 11 and a d-c motor 12 connected thereto by a drive shaft 13. Chill cylinder 11 is made of copper or other good thermal conductor and may be water cooled, and is driven by motor 12 at surface speeds in the order of 4,000 to 6,000 feet per minute. The circumferential chill surface of cylinder 11 is patterned to realize the continuous and direct casting of a strip of amorphous metal motor laminations 14, and has copper in a positive pattern 15 corresponding to the shaped lamination being processed and flush-mounted thermal insulating inserts 16 in a negative pattern for the outline and "punched-out" winding slot portion of the lamination. That is, the lamination shape is made of high thermal conductivity material and is surrounded (or at least partially surrounded) by a low thermal conductivity material such as alumina. Therefore, the molten metal as it is cast is quenched or cooled at different rates.

The amorphous metal being processed can be any of the magnetic alloys, and many different compositions for magnetic applications are presently known, having iron, nickel or cobalt, or any combination of these three metals, with boron and possibly phosphorous. The preferred composition because of its high induction characteristics is the $Fe_{80}B_{20}$ alloy, and another suitable amorphous metal is $Fe_{40}Ni_{40}P_{14}B_6$ or the variation of this material sold as METGLAS(R) Alloy Ribbon 2826MB by Allied Chemical Corp. A crucible or furnace 17 for the liquid alloy melt is maintained at a designated temperature by an induction heating coil or electrical resistance coil, and has at its lower end a nozzle with orifices or a slit arranged to deliver a stream 18 of alloy melt to the patterned rotating circumferential surface of chill cylinder 11. Gas pressure is applied to the top surface of the melt to extrude the material through the nozzle orifices. Capability for the chill block casting of amorphous metal in wide ribbon exceeding one-half inch in width is assumed, and one such method and apparatus are described in co-pending application Ser. No. 885,436, filed on Mar. 10, 1978 by John L. Walter, entitled "Method and Apparatus For Producing Amorphous Metallic Alloy Ribbons of Substantially Uniform Width and Thickness" and assigned to the same assignee as this invention. This apparatus generates a puddle of generally upstanding boot shape which is sustained during chill roll ribbon production by a single metal stream or jet or by a plurality of them arranged to impinge on the chill roll surface over an area the size of the desired puddle. The gas pressure and other variables affecting the liquid metal streams or jets feeding the puddle from a stationary source are carefully regulated. For further information on the fabrication of wide ribbon, reference may be made to Chapter 2 of the book "Metallic Glasses", *American Society for Metals,* Metals Park, Ohio, 1978, Library of Congress Catalog Card No. 77-24014.

The stream or jet 18 of liquid alloy is splatted onto the chill surface and metered to the speed of rotating cylinder 11 to make a ribbon thinner than 0.003 inch. The molten alloy as it impinges on the circumferential surface of the roll loses its heat to the large rotating mass and changes to a solid almost immediately. As the alloy melt comes in contact with the high thermal conductivity copper pattern 15 it becomes amorphous, and that which makes contact with the thermally insulating material 16 cools more slowly and becomes crystalline. In order to make amorphous metal, the fabrication technique must cool the glass forming melt at a rate greater than its critical quench rate, and the cooling rate for these materials is about $10^6$°C./sec. or higher. Alloy melt splatted onto negative pattern 16 made of low thermal conductivity material is in contact with the rapidly rotating chill cylinder 11 for a very short time (microseconds) and cools at a rate less than the critical value.

Ribbon 14 is formed continuously at high lineal speeds and almost immediately separates from the rapidly rotating circumferential chill surface under the action of centrifugal force. The ribbon at this point is naturally straight with a relatively uniform width, and is composed of ductile amorphous metal in the shaped lamination pattern and brittle crystalline metal in all other areas. The brittle crystalline scrap is now broken away or otherwise removed from the amorphous metal which is the object lamination. A vibrator 19 is mounted above strip 14 near where it separates from the patterned casting region of chill cylinder 11 and is operative to mechanically tap the rapidly moving strip to break unwanted crystalline metal into flake or dust particles 20. A conveyor belt 21 located beneath vibrator 19 collects crystalline scrap particles 20 so that they can be stored or immediately directed back to the melt in crucible 17 thereby saving handling and transportation costs for the scrap generated by the fabrication process. New raw metallic and glasseous materials are added to the melt along with the scrap particles as may be required. The infinitely long strip 14 of shaped amorphous metal laminations produced by this embodiment of the apparatus is naturally straight and is propelled off the periphery of chill cylinder 11 in a direction at right angles to the axis of rotation of the cylinder. Strip 14 is wound radially on a spool (like a spool of tape) and after being cut to length is ready for assembly in a motor stator or rotor core.

Figure 2:
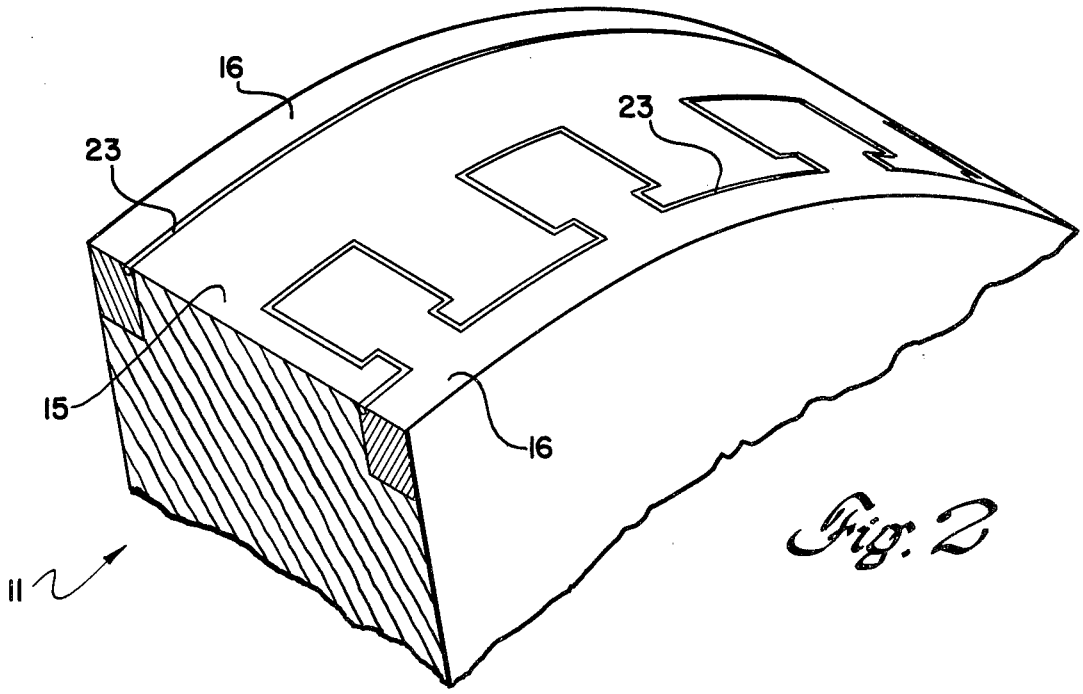
FIG. 2 is a partial perspective view of the circumferential surface of the chill roll in FIG. 1 as modified to have a heated wire at the interface between the high thermal conductivity metal and low thermal conductivity material.

The patterned chill surface of chill roll 11 in FIG. 2 is modified to have a heated wire 23 at the interface between the positive pattern 15 of copper or other good thermal conductor and flush-mounted negative pattern 16 of thermally insulating material. The heated wire is located at the transition zone between amorphous and crystalline metal and establishes a definitive cold-warm barrier so that patterned strip 14 has clean, smooth edges. To give an example, the $Fe_{80}B_{20}$ amorphous metal alloy melt is maintained at 1350° C. in the crucible and after being splatted onto the circumferential chill surface must cool very rapidly and solidify in a matter of microseconds. Heated wire 23 establishes a sharp transition between amorphous and crystalline metal and prevents production of a jagged edge in the finished product. Thermal insulator inserts 16 are made of alumina or other low thermal conductivity material that is mechanically compatible with copper and expands and contracts at about the same rate.

Figure 3:
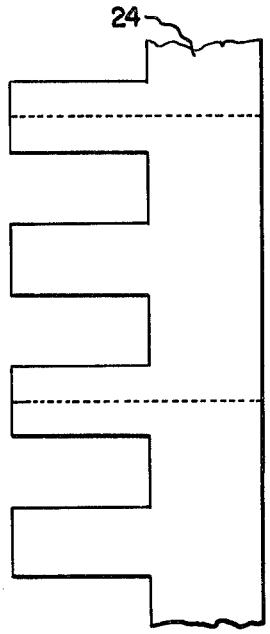
FIG. 3 is a plan view of a fabricated strip of "E" type transformer laminations.

The strip of shaped laminations can be fabricated in many different geometrical patterns, including holes of various shapes entirely surrounded by amorphous metal, limited only by the requirement of a transition zone as just discussed. Laminations for a variety of inductive or magnetic components can be manufactured automatically and continuously at low cost, and prime examples are laminations for motors, generators and transformers. Amorphous metal strip 24 in FIG. 3 is patterned in the form of "E" type transformer laminations that are cut apart at a later stage along the dashed lines, and "C" and "U" laminations are other well-known configurations among the many shapes that can be fabricated. Further modifications of the fabrication process are that several inductive vibrators can be mounted in series to break up and remove scrap crystalline areas, and the vibrating step may be performed ultrasonically and, in some cases, may be done after coiling the strip or after assembly in the product. In any event, it is always advantageous to collect and recycle the scrap crystalline metal particles.

Figure 4:
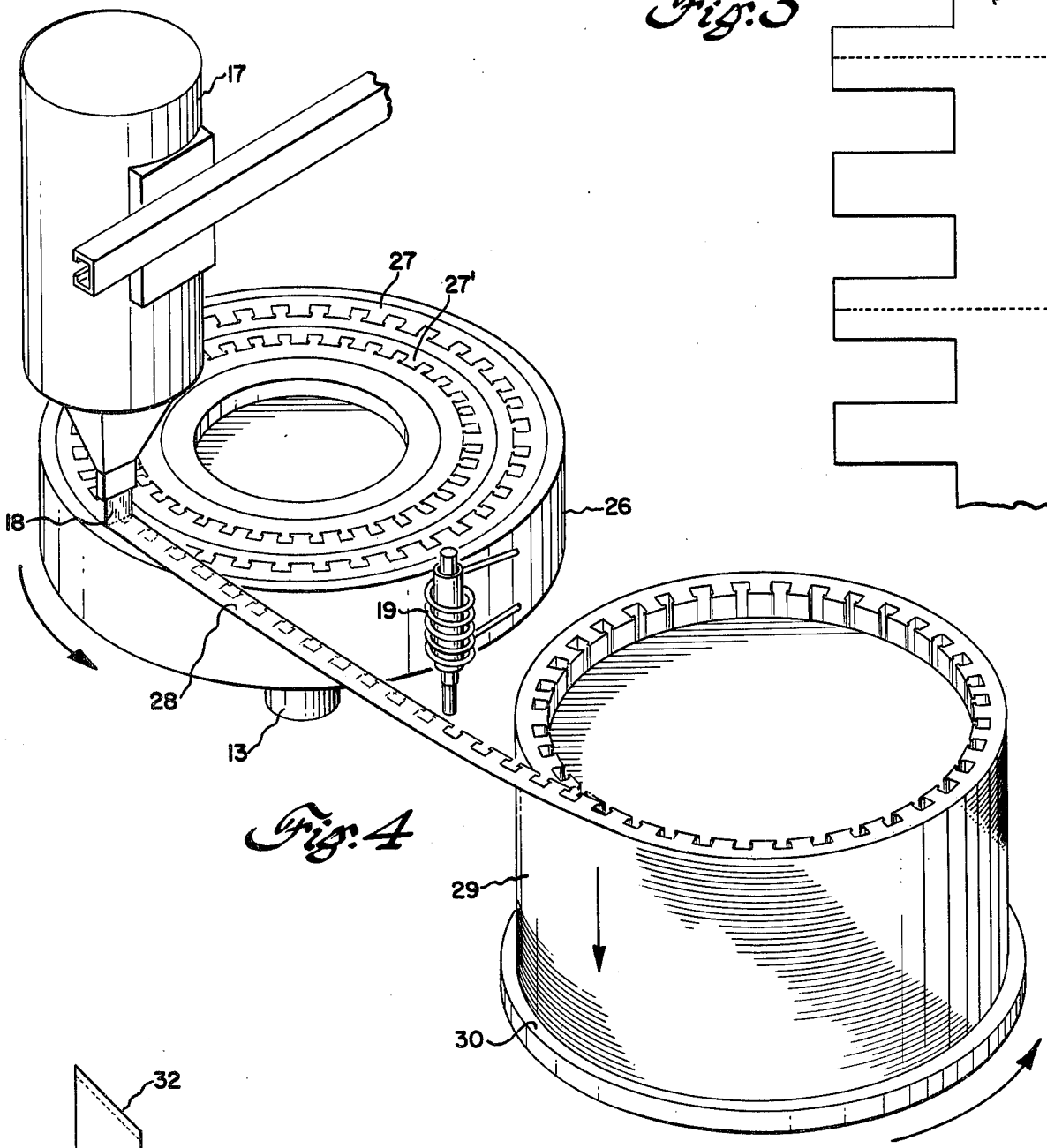
FIG. 4 is a diagrammatic perspective view of a modification of the apparatus in FIG. 1 in which the copper chill roll is rotated about a vertical axis to make a helically wound lamination.

The second embodiment of apparatus for the one-process automatic fabrication of a strip of amorphous metal laminations directly from the alloy melt is illustrated in FIG. 4. The motor lamination strip or tape made by this apparatus is naturally curved or curled, rather than being naturally straight as in FIG. 1, and is coiled up in a helical configuration with a diameter determined by operating and apparatus parameters. Chill roll or cylinder 26 is mounted for rotation at high speeds about a vertical axis, and the patterned circular chill surface or casting region 27 is on the flat top surface of the chill roll. Casting region 27, as in FIG. 1, has a copper pattern corresponding to the shaped lamination being fabricated which is entirely surrounded by thermal insulating inserts, with the difference that the inner edge circumference, because of the difference of radii, is shorter than the outer edge circumference. Stream 18 of molten alloy is extruded under pressure from crucible 17 and impinges on the chill surface and solidifies within a matter of microseconds. As chill cylinder 26 turns, the solidifying thin film of metal remains on the chill surface for a short while and is given a definite curvature, and then separates from the chill surface under the action of centrifugal force and passes beneath vibrator 19 where the brittle crystalline areas are broken into scrap particles leaving only the object lamination made of ductile amorphous metal. The continuously fabricated, naturally curved strip of laminations 28 is coiled up helically at 29 on a rotating table 30 which lowers automatically as the helical winding proceeds. This may be referred to as a Slinky ® spring toy winding; the lamination is on edge when manufactured into a stator magnetic core. The amount of curvature given to the strip of laminations and the diameter of helically-wound laminated structure 29 is a function of the diameter of patterned casting region 27 on disc 26 and the speed of rotation of the disc.

Two or more concentric patterned casting regions 27 and 27' may be built into the top surface of the disc, and crucible 17 is then mounted for radial movement from track to track. The use of casting region 27' of smaller diameter, assuming the speed of rotation of the chill cylinder is the same, results in fabricating a toothed ribbon of amorphous metal which coils up into a laminated structure of smaller diameter. A process variation is that helically wound tape of uniform width is manufactured and then placed on a vibrator to remove unwanted crystalline metal and delineate the preselected lamination shape. Scrap crystalline particles are collected and returned to the melt to mix with new raw materials. Continuous fabrication of a naturally curved, helically wound strip of shaped amorphous metal laminations is achieved conveniently and econmically by this process, whereas separate punching of a strip following the prior art procedures would be very difficult.

Figure 5:
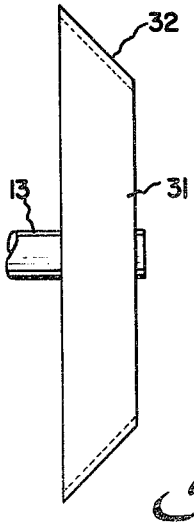
FIG. 5 shows an alternative chill roll configuration for fabricating helically wound laminations.

One alternate chill roll configuration for the fabrication of naturally curved, patterned amorphous metal tape is illustrated in FIG. 5 and others are possible. Chill roll 31 is vertically oriented as in FIG. 1 for rotation by drive shaft 13 about a horizontal axis, and has an inclined circumferential surface into which is built a patterned casting region or chill surface 32 similar to that in FIG. 4. One edge of the pattern is at a larger radius than the other edge, and the larger radius edge travels faster than the smaller radius edge and the strip is given a curl as it separates from the wheel by centrifugal force. A more acute angle of inclination results in a smaller diameter helix. The speed of rotation of the cylinder must be controlled accurately to realize a constant diameter.

In conclusion, this invention enables the fabricator to change raw materials such as scrap iron and glasseous elements into a lamination ready for assembly, after cutting to length, into an inductive component in one process. Substantial savings in materials and labor are realized and all scrap resulting from the process is recycled.

While the invention has been particularly shown and described with reference to several preferred embodiments of the method and apparatus, it will be understood by those skilled in the art that the foregoing and other changes in form and detail may be made therein without departing from the spirit and scope of the invention.

What is claimed is:

1. A method of fabricating geometrically shaped laminations of amorphous metal alloy for inductive components comprising the steps of delivering a stream of liquid alloy melt against a relatively rapidly moving chill surface having high thermal conductivity material in a pattern corresponding to the shaped lamination being processed which is at least partially surrounded by low thermal conductivity material, quenching the alloy melt at different cooling rates to continuously form a ribbon of solidified metal which separates from the chill surface and is composed of ductile amorphous metal in the shaped lamination pattern and brittle crystalline metal in other areas, and removing the crystalline metal areas of the ribbon to leave only a strip of amorphous metal laminations.

2. The method of claim 1 wherein the step of removing crystalline metal is performed by mechanically vibrating the ribbon shortly after separating from the chill surface.

3. The method of claim 2 further including the step of collecting the scrap particles of crystalline metal broken away from the ribbon.

4. The method of claim 3 further including the step of recycling the scrap particles to the alloy melt.

5. The method of claim 1 further including the steps of collecting the scrap particles of crystalline metal removed from the ribbon, and recycling the scrap particles to the alloy melt.

6. A method of fabricating geometrically shaped laminations of magnetic amorphous metal alloy for inductive components comprising the steps of delivering a stream of liquid alloy melt against the relatively rapidly rotating circumferential surface of a cylindrical chill roll having high thermal conductivity material in a circular pattern corresponding to the shaped lamination being processed which is surrounded by low thermal conductivity material, quenching the alloy melt at different cooling rates to continuously form a ribbon of solidified metal which separates from the circumferential surface under the action of centrifugal force and is composed of ductile amorphous metal in the shaped lamination pattern and brittle crystalline metal in other areas, vibrating the ribbon to break away the crystalline metal areas leaving only a strip of amorphous metal laminations, collecting the scrap particles of crystalline metal removed from the ribbon, and admitting the scrap particles to the alloy melt along with new raw materials.

7. The method of claim 6 wherein the vibrating step is performed by mechanically tapping the ribbon shortly after separating from the rotating circumferential surface of the chill roll.

8. A method of fabricating geometrically shaped laminations of magnetic amorphous metal alloy for inductive components comprising the steps of delivering a stream of liquid alloy melt against the relatively rapidly rotating flat top surface of a cylindricall chill roll having high thermal conductivity material in a circular pattern corresponding to the shaped lamination being processed which is surrounded by low thermal conductivity material, quenching the alloy melt at different cooling rates to continuously form a ribbon of solidified metal which separates from the flat top surface of the chill roll under the action of centrifugal force and is composed of ductile amorphous metal in the shaped lamination pattern and brittle crystalline metal in other areas, vibrating the ribbon to break away the crystalline metal areas leaving only a strip of amorphous metal laminations, collecting the scrap particles of crystalline metal removed from the ribbon, and admitting the scrap particles to the alloy melt along with new raw materials.

9. The method of claim 8 wherein the vibrating step is performed by mechanically tapping the ribbon shortly after separating from the rotating flat top surface of the chill roll.

10. Apparatus for the continuous and direct fabrication of shaped amorphous metal laminations for inductive components from alloy melt comprising a chill roll having a patterned surface region for casting contact with molten metal characterized by high thermal conductivity metal in a pattern corresponding to the shaped lamination being processed which is completely surrounded by flush-mounted low thermal conductivity material, means for continuously delivering amorphous alloy melt to the patterned casting region and means for rotating said chill roll to maintain continuous relative motion between said patterned casting region and melt delivery means, and means for vibrating the solidified metal ribbon after separation from the chill roll under the acton of centrifugal force to thereby break away brittle crystalline metal from ductile amorphous metal and produce a strip of shaped amorphous metal laminations.

11. The apparatus of claim 10 wherein the patterned casting region of said chill roll further has a heated wire at the interface between the high thermal conductivity metal pattern and the surrounding low thermal conductivity material areas to realize a sharp transition between amorphous metal and crystalline metal in the solidified metal ribbon before breaking away scrap crystalline metal.

12. The apparatus of claim 10 or claim 11 wherein said rotating means rotates said chill roll about a horizontal axis and wherein the patterned casting region is on the circumferential surface of said chill roll which is inclined so that the strip of shaped laminations is naturally curved and can be helically wound.

13. The apparatus of claim 10 or claim 11 wherein said rotating means rotates said chill roll about a vertical axis and wherein the patterned casting region is on the flat top surface of said chill roll and is circular so that the strip of shaped laminations is naturally curved and can be helically wound.

14. The apparatus of claim 11 wherein said rotating means rotates said chill roll about a vertical axis and wherein there are several concentric and circular patterned casting regions on the flat top surface of said chill roll so that the strip of shaped laminations is naturally curved and can be helically wound with a diameter dependent on the diameter of the selected patterned casting region and the speed of rotation.

* * * * *